US006308910B1

(12) United States Patent
Booth

(10) Patent No.: US 6,308,910 B1
(45) Date of Patent: Oct. 30, 2001

(54) PAPER DISPENSING APPARATUS

(76) Inventor: Darrell W. Booth, 14219 4th Ave. Ct. S., Tacoma, WA (US) 98444

( * ) Notice: Subject to any disclaimer, the term of this patent is extended or adjusted under 35 U.S.C. 154(b) by 0 days.

(21) Appl. No.: 09/569,621

(22) Filed: May 12, 2000

(51) Int. Cl.[7] ..... B65H 16/06

(52) U.S. Cl. ..... 242/598.3; 242/564.1; 242/565; 242/599.1; 242/599.4

(58) Field of Search ..... 242/564.1, 565, 242/598.3, 599.1, 599.4

(56) References Cited

U.S. PATENT DOCUMENTS

| | | | | |
|---|---|---|---|---|
| D. 291,518 | | 8/1987 | Chap . | |
| 3,770,221 | | 11/1973 | Stern . | |
| 4,239,163 | | 12/1980 | Christian . | |
| 5,076,510 | | 12/1991 | Norlander . | |
| 5,340,047 | * | 8/1994 | Heller | 242/596.1 |
| 5,415,357 | | 5/1995 | Smith, Jr. . | |
| 5,758,843 | * | 6/1998 | Ongaro | 242/565 |
| 5,762,285 | | 6/1998 | Lin . | |
| 5,769,350 | * | 6/1998 | Oka | 242/422.4 |

* cited by examiner

*Primary Examiner*—Donald P. Walsh
*Assistant Examiner*—Jonathan R. Miller

(57) ABSTRACT

A paper dispensing apparatus for preventing paper from unraveling from the roll. The paper dispensing apparatus includes a pair of bracket members adapted to be securely mounted to a wall structure; and also includes a first tubular member either being securely mounted to the bracket members or having bracket mounting members which are securely mounted to the bracket member, the first tubular member having grooves at the ends thereof and also having two opposed holes extending in the side wall to either side of the first tubular member; and further includes a second tubular member rotatably mounted about the first tubular member and having a pair of annular flanges extending inwardly and at the ends thereof and being rotatably received in the grooves, the first tubular member also having a pair of opposed holes extending in the side wall to either side thereof; and also includes a paper roll engagement member being securely mounted about the second tubular member and having a pair of opposed holes extending in the side wall and to either side thereof; and further includes an elastic member extended through the holes for recoiling the second tubular member after paper has been dispensed from the roll of paper.

17 Claims, 2 Drawing Sheets

PAPER DISPENSING APPARATUS

BACKGROUND OF THE INVENTION

1. Field of the Invention

The present invention relates to a paper recoilable dispenser and more particularly pertains to a new paper dispensing apparatus for preventing paper from unraveling from the roll.

2. Description of the Prior Art

The use of a paper recoilable dispenser is known in the prior art. More specifically, a paper recoilable dispenser heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,239,163; 3,770,221; 5,762,285 5,076,510; 5,415,357; and U.S. Pat. No. Des. 291,518.

While these devices fulfill their respective, particular objectives and requirements, the aforementioned patents do not disclose a new paper dispensing apparatus. The inventive device includes a pair of bracket members adapted to be securely mounted to a wall structure; and also includes a first tubular member either being securely mounted to the bracket members or having bracket mounting members which are securely mounted to the bracket member, the first tubular member having grooves at the ends thereof and also having two opposed holes extending in the side wall to either side of the first tubular member; and further includes a second tubular member rotatably mounted about the first tubular member and having a pair of annular flanges extending inwardly and at the ends thereof and being rotatably received in the grooves, the first tubular member also having a pair of opposed holes extending in the side wall to either side thereof; and also includes a paper roll engagement member being securely mounted about the second tubular member and having a pair of opposed holes extending in the side wall and to either side thereof; and further includes an elastic member extended through the holes for recoiling the second tubular member after paper has been dispensed from the roll of paper.

In these respects, the paper dispensing apparatus according to the present invention substantially departs from the conventional concepts and designs of the prior art, and in so doing provides an apparatus primarily developed for the purpose of preventing paper from unraveling from the roll.

SUMMARY OF THE INVENTION

In view of the foregoing disadvantages inherent in the known types of a paper recoilable dispenser now present in the prior art, the present invention provides a new paper dispensing apparatus construction wherein the same can be utilized for preventing paper from unraveling from the roll.

The general purpose of the present invention, which will be described subsequently in greater detail, is to provide a new paper dispensing apparatus which has many of the advantages of the paper recoilable dispenser mentioned heretofore and many novel features that result in a new paper dispensing apparatus which is not anticipated, rendered obvious, suggested, or even implied by any of the prior art paper recoilable dispenser, either alone or in any combination thereof.

To attain this, the present invention generally comprises a pair of bracket members adapted to be securely mounted to a wall structure; and also includes a first tubular member either being securely mounted to the bracket members or having bracket mounting members which are securely mounted to the bracket member, the first tubular member having grooves at the ends thereof and also having two opposed holes extending in the side wall to either side of the first tubular member; and further includes a second tubular member rotatably mounted about the first tubular member and having a pair of annular flanges extending inwardly and at the ends thereof and being rotatably received in the grooves, the first tubular member also having a pair of opposed holes extending in the side wall to either side thereof; and also includes a paper roll engagement member being securely mounted about the second tubular member and having a pair of opposed holes extending in the side wall and to either side thereof; and further includes an elastic member extended through the holes for recoiling the second tubular member after paper has been dispensed from the roll of paper.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paper dispensing apparatus which has many of the advantages of the paper recoilable dispenser mentioned heretofore and many novel features that result in a new paper dispensing apparatus which is not anticipated, rendered obvious, suggested, or even implied by any of the prior art paper recoilable dispenser, either alone or in any combination thereof.

It is another object of the present invention to provide a new paper dispensing apparatus which may be easily and efficiently manufactured and marketed.

It is a further object of the present invention to provide a new paper dispensing apparatus which is of a durable and reliable construction.

An even further object of the present invention is to provide a new paper dispensing apparatus which is susceptible of a low cost of manufacture with regard to both materials and labor, and which accordingly is then susceptible of low prices of sale to the consuming public, thereby making such paper dispensing apparatus economically available to the buying public.

Still yet another object of the present invention is to provide a new paper dispensing apparatus which provides in the apparatuses and methods of the prior art some of the advantages thereof, while simultaneously overcoming some of the disadvantages normally associated therewith.

Still another object of the present invention is to provide a new paper dispensing apparatus for preventing paper from unraveling from the roll.

Yet another object of the present invention is to provide a new paper dispensing apparatus which includes a pair of bracket members adapted to be securely mounted to a wall structure; and also includes a first tubular member either being securely mounted to the bracket members or having bracket mounting members which are securely mounted to the bracket member, the first tubular member having grooves at the ends thereof and also having two opposed holes extending in the side wall to either side of the first tubular member; and further includes a second tubular member rotatably mounted about the first tubular member and having a pair of annular flanges extending inwardly and at the ends thereof and being rotatably received in the grooves, the first tubular member also having a pair of opposed holes extending in the side wall to either side thereof; and also includes a paper roll engagement member being securely mounted about the second tubular member and having a pair of opposed holes extending in the side wall and to either side thereof; and further includes an elastic member extended through the holes for recoiling the second tubular member after paper has been dispensed from the roll of paper.

Still yet another object of the present invention is to provide a new paper dispensing apparatus that reduces waste of paper by preventing the unraveling of paper from the roll.

Even still another object of the present invention is to provide a new paper dispensing apparatus that is easy and convenient to use and install.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
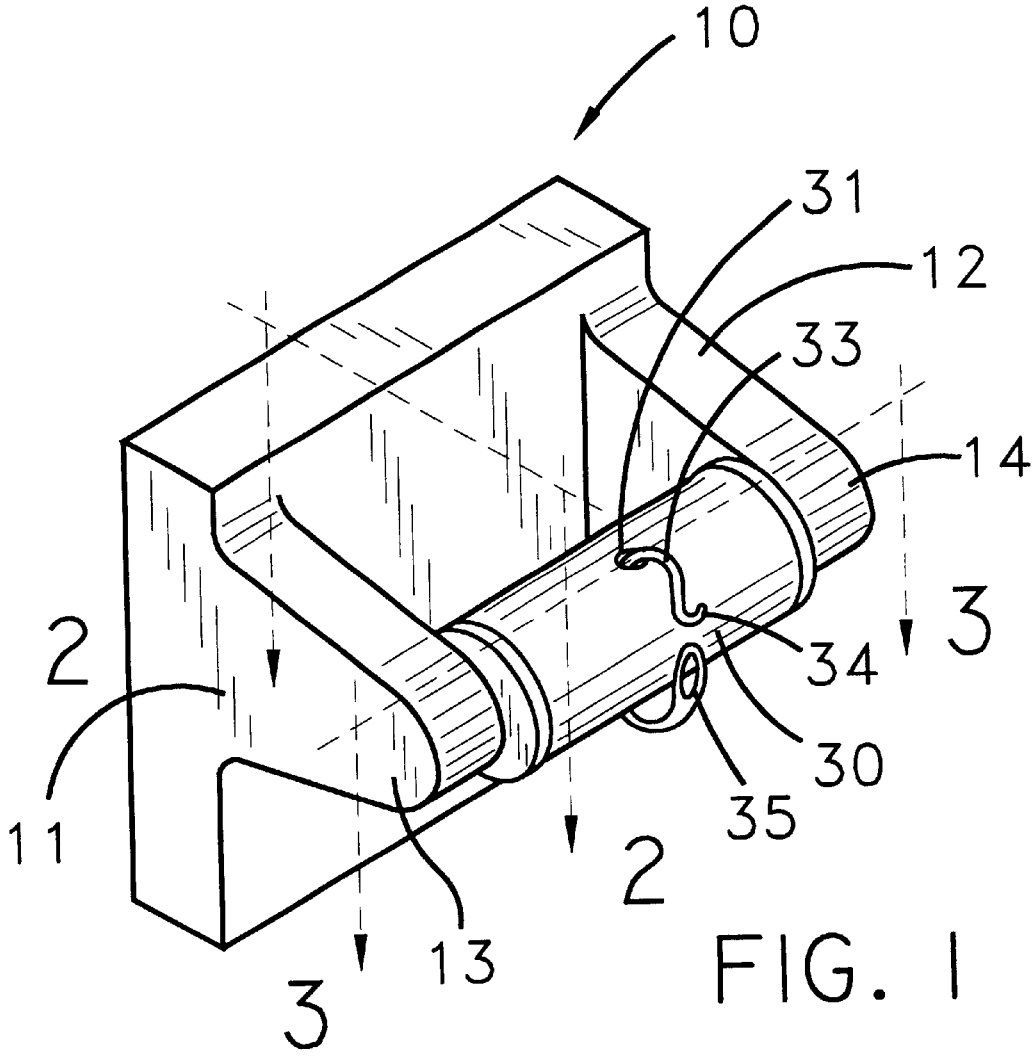
FIG. 1 is a perspective view of a new paper dispensing apparatus according to the present invention.
Figure 2:
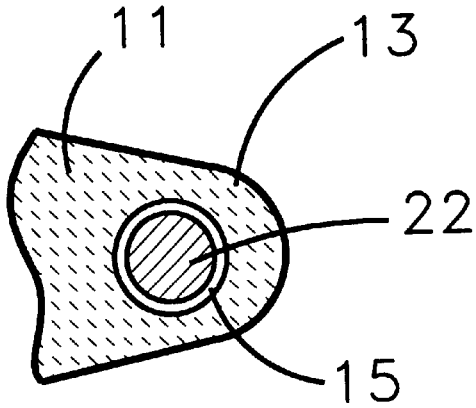
FIG. 2 is a side cross-sectional view one of the bracket members of the present invention.
Figure 3:
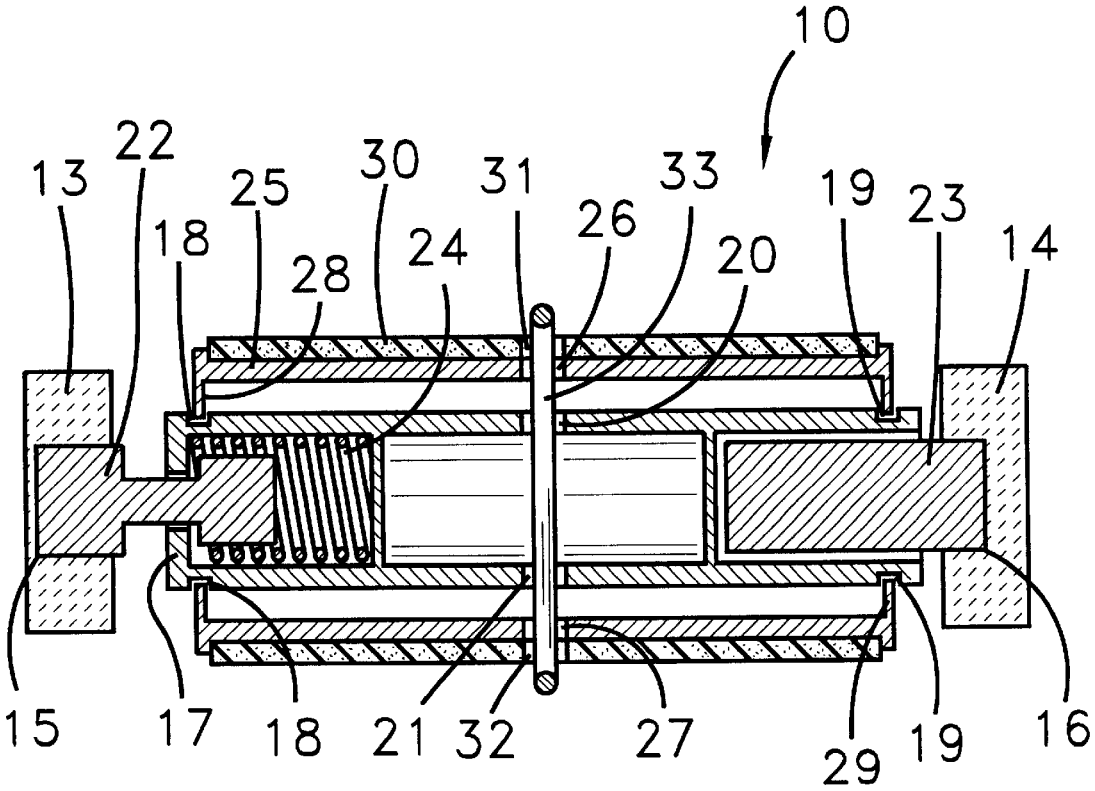
FIG. 3 is a front cross-sectional view of the present invention.

With reference now to the drawings, and in particular to FIGS. 1 through 3 thereof, a new paper dispensing apparatus embodying the principles and concepts of the present invention and generally designated by the reference numeral 10 will be described.

As best illustrated in FIGS. 1 through 3, the paper dispensing apparatus 10 generally comprises a pair of opposed bracket members 11,12 being spaced apart and being adapted to be securely mounted to a wall structure. A means being removably mounted to the bracket members 11,12 for supporting a second tubular member includes a first tubular member 17 securely supported by the bracket members 11,12 and having a pair of grooves 18,19 extending in an exterior of a first side wall thereof and having a pair of opposed holes 20,21 extending through the first side wall to either side of the first tubular member 17. The grooves 18,19 extend laterally about a circumference of the first tubular member 17. Each of the bracket members 11,12 includes an end portion 13,14 having a multiple-sided slot 15,16 therein to prevent rotation of the first tubular member 17. The grooves 18,19 are spaced apart with one the grooves 18 being disposed near one end of the first tubular member 17 and the other of the grooves 19 being disposed near the other end of the first tubular member 17. A second tubular member 25 has a second side wall, open ends and a bore extending therethrough. The second tubular member 25 is rotatably mounted about the first tubular member 17 with the second tubular member 25 having a pair of opposed holes 26,27 extending through the second side wall and to either side of the second tubular member 25. The second tubular member 25 includes a pair of annular flanges 28,29 extending inwardly of the second tubular member 25 with each of the annular flanges 28,29 being rotatably received in a respective groove 18,19. The annular flanges 28,29 include a first one 28 of the annular flanges being securely and conventionally disposed at one end of the second tubular member 25 and also include a second one 29 of the annular flanges being securely and conventionally disposed at the other end of the second tubular member 25. A paper roll engagement member 30 is securely and conventionally mounted about the second tubular member 25 and being adapted to engage a paper roll and having a pair of opposed holes 31,32 extending through a side wall and to either side thereof. The paper roll engagement member 30 is essentially a sponge-like member. An elastic member 33 is extended through the holes 20,21,26,27 of the first and second tubular members 17,25 and through the holes 31,32 of the paper roll engagement member 30. The elastic member 33 has a first end 35 and a second end 34 with the first end 35 terminating in a loop and the second end 34 terminating in a hook. The first end 35 is removably fastened to the second end 34 with the elastic member 33 being removably fastened to the paper roll engagement member 30 and to the first and second tubular members 17,25 to essentially recoil the second tubular member 25 relative to the first tubular member 17 after paper has being unwound from a roll of paper.

As a first embodiment, the first tubular member 17 includes a first end and a second end with the ends of the first tubular member 17 having multiple sides and being removably received in the multiple-sided slots 15,16 of the bracket members 11,12 to prevent the first tubular member 17 from rotating upon the bracket members 11,12.

As a second embodiment, the means being removably mounted to the bracket members for supporting the second tubular member further includes a pair of bracket mounting members 22,23 with a first one 23 of the bracket mounting members being securely disposed in a first end of the first tubular member 17 and with a second one 22 of the bracket mounting members being movably extended in a second end of the first tubular member 17. The means being removably mounted to the bracket member for supporting the second tubular member also includes a spring 24 being disposed in the second end of the first tubular member 17 for biasing the second one 22 of the bracket mounting members outwardly of the first tubular member 17 to engage one of the bracket members 11.

In use, the user, after extending the elastic member 33 through the holes 20,21,26,27,31,32 in the first and second tubular members 17,25 and in the paper roll engagement member 30 and fastening the elastic member 33 together, mounts a roll of paper about the paper roll engagement member 30 and mounts the first tubular member 17 to the bracket members 11,12. When the user unwinds paper from the roll of paper, the second tubular member 25 is rotated upon the first tubular member 17 according to the amount of paper being taken off the roll. After the user has removed the paper from the roll, the second tubular member 25 will recoil and rotate in the reverse direction because of the elastic member 33 so that the paper will not continue to unravel from the roll after a selected amount of paper has been removed from the roll.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paper dispensing apparatus comprising:

a pair of opposed bracket members being spaced apart and being adapted to be securely mounted to a wall structure;

a means being removably mounted to said bracket member for supporting a second tubular member including a first tubular member securely supported by said bracket members and having a pair of grooves extending in an exterior of a first side wall thereof and having a pair of opposed holes extending through said first side wall to one side of said first tubular member, said grooves extending laterally about a circumference of said first tubular member;

a second tubular member having a second side wall, open ends and a bore extending therethrough, said second tubular member being rotatably mounted about said first tubular member, said second tubular member having a pair of opposed holes extending through said second side wall and to either side of said second tubular member;

a paper roll engagement member securely mounted about said second tubular member and being adapted to engage a paper roll and having a pair of opposed holes extending through a side wall to either side thereof; and an elastic member extended through said holes of said first and second tubular members and through said holes of said paper roll engagement member.

2. A paper dispensing apparatus as described in claim 1, wherein said grooves are spaced apart with one of said grooves being disposed near one end of said first tubular member and the other of said grooves being disposed near the other end of said first tubular member.

3. A paper dispensing apparatus as described in claim 1, wherein said second tubular member includes a pair of annular flanges extending inwardly of said second tubular member, each of said annular flanges being rotatably received in a respective said groove.

4. A paper dispensing apparatus as described in claim 3, wherein said annular flanges includes a first one of said annular flanges being securely disposed at one end of said second tubular member and also includes a second one of said annular flanges being securely disposed at the other end of said second tubular member.

5. A paper dispensing apparatus as described in claim 1, wherein said paper roll engagement member is a sponge member.

6. A paper dispensing apparatus as described in claim 1, wherein said elastic member has a first end and a second end, said first end terminating in a loop and said second end terminating in a hook, said first end being removably fastened to said second end, said elastic member being removably fastened to said paper roll engagement member and said first and second tubular members to recoil said second tubular member relative to said first tubular member after paper has been unwound from a roll of paper.

7. A paper dispensing apparatus as described in claim 1, wherein said means being removably mounted to said bracket members for supporting said second tubular member further includes a pair of bracket mounting members with a first one of said bracket mounting members being securely disposed in a first end of said first tubular member and with a second one of said bracket mounting members being movably extended in a second end of said first tubular member.

8. A paper dispensing apparatus as described in claim 1, wherein said means being removably mounted to said bracket members for supporting said second tubular member also includes a spring being disposed in said second end of said first tubular member for biasing said second one of said bracket mounting members outwardly of said first tubular member to engage one of said bracket members.

9. A paper dispensing apparatus comprising:

a pair of opposed bracket members being spaced apart and being adapted to be securely mounted to a wall structure;

a means being removably mounted to said bracket members for supporting a second tubular member including a first tubular member securely supported by said bracket members and having a pair of grooves extending in an exterior of a first side wall thereof and having a pair of opposed holes extending through said first side wall to one side of said first tubular member, said grooves extending laterally about a circumference of said first tubular member, said grooves being spaced apart with one said groove being disposed near one end of said first tubular member and the other of said grooves being disposed near the other end of said first tubular member;

a second tubular member having a second side wall, open ends and a bore extending thereof, said second tubular member being rotatably mounted about said first tubular member, said second tubular member having a pair of opposed holes extending through said second side wall and to either side of said second tubular member, said second tubular member including a pair of annular flanges extending inwardly of said second tubular member, each of said annular flanges being rotatably received in a respective said groove, said annular flanges including a first one of said annular flanges being securely disposed at one end of said second tubular member and also including a second one of said annular flanges being securely disposed at the other end of said second tubular member;

a paper roll engagement member securely mounted about said second tubular member and being adapted to engage a paper roll and having a pair of opposed holes extending through a side wall to either side thereof, said paper roll engagement member being a sponge member; and an elastic member extended through said holes of said first and second tubular members and through said holes of said paper roll engagement member, said elastic member having a first end and a second end, said first end terminating in a loop and said second end terminating in a hook, said first end being removably fastened to said second end, said elastic member being removably fastened to said paper roll engagement member and said first and second tubular members to recoil said second tubular member relative to said first tubular member after paper has being unwound from a roll of paper.

10. A paper dispensing apparatus as described in claim 9, wherein said means being removably mounted to said bracket members for supporting said second tubular member further includes a pair of bracket mounting members with a first one of said bracket mounting members being securely disposed in a first end of said first tubular member and with a second one of said bracket mounting members being movably extended in a second end of said first tubular member, said means being removably mounted to said bracket members for supporting said second tubular member also including a spring being disposed in said second end of said first tubular member for biasing said second one of said bracket mounting members outwardly of said first tubular member to engage one of said bracket members.

11. A paper dispensing apparatus comprising:

a pair of opposed bracket members for being mounted on a wall structure in a spaced apart relationship;

a means being removably mounted to said bracket member for supporting a second tubular member, said means including a first tubular member supported by said bracket members and having a pair of grooves extending in an exterior of a first side wall thereof and having a pair of opposed holes extending through said first side wall to one side of said first tubular member, said grooves extending laterally about a circumference of said first tubular member;

a second tubular member having a second side wall, open ends and a bore extending therethrough, said second tubular member being rotatably mounted about said first tubular member, said second tubular member having a pair of opposed holes extending through said second side wall and to either side of said second tubular member;

a paper roll engagement member mounted about said second tubular member and being adapted to engage a paper roll and having a pair of opposed holes extending through a side wall to either side thereof; and an elastic member extended through said holes of said first and second tubular members and through said holes of said paper roll engagement member.

12. A paper dispensing apparatus as described in claim 11, wherein said grooves are spaced apart with one of said grooves being disposed near one end of said first tubular member and the other of said grooves being disposed near the other end of said first tubular member.

13. A paper dispensing apparatus as described in claim 11, wherein said second tubular member includes a pair of annular flanges extending inwardly of said second tubular member, each of said annular flanges being rotatably received in a respective said groove.

14. A paper dispensing apparatus as described in claim 13, wherein said annular flanges includes a first one of said annular flanges being disposed at one end of said second tubular member and also includes a second one of said annular flanges being securely disposed at the other end of said second tubular member.

15. A paper dispensing apparatus as described in claim 11, wherein said elastic member has a first end and a second end, said first end terminating in a loop and said second end terminating in a hook, said first end being removably fastened to said second end, said elastic member being removably fastened to said paper roll engagement member and said first and second tubular members to recoil said second tubular member relative to said first tubular member after paper has been unwound from a roll of paper.

16. A paper dispensing apparatus as described in claim 11, wherein said means being removably mounted to said bracket members for supporting said second tubular member further includes a pair of bracket mounting members with a first one of said bracket mounting members being disposed in a first end of said first tubular member and with a second one of said bracket mounting members being movably extended in a second end of said first tubular member.

17. A paper dispensing apparatus as described in claim 11, wherein said means being removably mounted to said bracket members for supporting said second tubular member also includes a spring being disposed in said second end of said first tubular member for biasing said second one of said bracket mounting members outwardly of said first tubular member to engage one of said bracket members.

* * * * *